US009127676B2

(12) United States Patent
Vanneste et al.

(10) Patent No.: US 9,127,676 B2
(45) Date of Patent: Sep. 8, 2015

(54) METHOD FOR THE AXIAL POSITIONING OF BEARINGS ON A SHAFT JOURNAL

(75) Inventors: Sofie Kris Vanneste, Hamme (BE); Bart Bernaerts, Waver (BE)

(73) Assignee: ATLAS COPCO AIRPOWER N.V., Wilrijk (BG)

( * ) Notice: Subject to any disclaimer, the term of this patent is extended or adjusted under 35 U.S.C. 154(b) by 430 days.

(21) Appl. No.: 13/500,523

(22) PCT Filed: Sep. 27, 2010

(86) PCT No.: PCT/BE2010/000067
§ 371 (c)(1),
(2), (4) Date: Apr. 5, 2012

(87) PCT Pub. No.: WO2011/041856
PCT Pub. Date: Apr. 14, 2011

(65) Prior Publication Data

US 2012/0201711 A1 Aug. 9, 2012

(30) Foreign Application Priority Data

Oct. 8, 2009 (BE) ..... 2009/0613

(51) Int. Cl.
*F04C 18/16* (2006.01)
*F01C 21/02* (2006.01)

(52) U.S. Cl.
CPC ..... *F04C 18/16* (2013.01); *F01C 21/02* (2013.01); *F04C 2230/602* (2013.01); *Y10T 29/49242* (2015.01); *Y10T 29/49696* (2015.01)

(58) Field of Classification Search
CPC ..... B23P 15/003; F16C 33/64; F16C 35/06; F16C 35/063; F16C 35/067
USPC ..... 29/898.07; 384/564
See application file for complete search history.

(56) References Cited

U.S. PATENT DOCUMENTS

| | | | | |
|---|---|---|---|---|
| 4,730,995 | A | 3/1988 | Dewhirst | |
| 2010/0215306 | A1* | 8/2010 | Georgi et al. | 384/564 |
| 2011/0064347 | A1* | 3/2011 | Hubbard et al. | 384/564 |

FOREIGN PATENT DOCUMENTS

| | | |
|---|---|---|
| GB | 1464239 | 2/1977 |
| GB | 2169361 A | 7/1986 |

OTHER PUBLICATIONS

International Search Report in PCT/BE2010/000067, May 2, 2011.

* cited by examiner

*Primary Examiner* — Moshe Wilensky
(74) *Attorney, Agent, or Firm* — Bacon & Thomas, PLLC

(57) ABSTRACT

A method for the axial positioning of bearings on a shaft journal of a rotor whereby the axial play of the rotor in its housing is adjusted by affixing a spacer ring and two bearings with an interference fit such that the outer race is moved axially with respect to the inner race of the same bearing over a distance that is a function of the desired axial play.

13 Claims, 5 Drawing Sheets

PRIOR ART

METHOD FOR THE AXIAL POSITIONING OF BEARINGS ON A SHAFT JOURNAL

BACKGROUND FIELD

The present invention relates to a method for the axial positioning of bearings on a shaft journal.

RELATED ART

In particular the invention covers the axial positioning and securing of a set of couplable bearings on a shaft journal extending through a part of the housing, whereby the axial play of the shaft in its housing can be set.

In a bearing set, two single-row angular contact bearings can either lie on one another in tandem, or be in an O configuration or X configuration, depending on whether the contact lines through the balls of the bearing to the central axis of the bearing concerned are in the same sense for both bearings (tandem), in the divergent sense (O or <> configuration), or in the convergent sense (X or >< configuration). Both in the X and the O configuration, the axial loads can be taken up in both directions, but only in one direction by each bearing.

Such a set of couplable bearings enables the shaft to move, after assembly, over an axial distance, i.e. the axial play in the bearing set after assembly, and this axial distance is equal to the difference between the maximum play and the minimum play of the shaft in its housing.

Such bearings are used for example in a screw compressor element with two mating rotors, i.e. a male and a female rotor, each with a helical body on a shaft that is supported by bearings in the housing of the compressor element.

Each rotor is bearing mounted in the end walls of the housing with its shaft journals, on an outlet side and an inlet side respectively, whereby the male or female rotor shaft on the outlet side is supported by a set of coupled bearings that are, for example, angular contact bearings in X configuration.

The traditional method for correctly setting the play between the rotating body of the rotor and the end walls of the housing consists of pressing the outer races of the bearing set against a shoulder in the housing, and the inner races against a spacer ring that is mounted against a shoulder of the shaft itself.

The thickness of the spacer ring/intermediate ring is determined by the axial distance between the two shoulders. This axial distance is measured while the axial play between the rotating body of the rotor and the end walls of the housing is set to zero, in other words while the rotor body is pressed against the housing in an axial direction. The operator selects the most appropriate thickness for the intermediate ring and fits the intermediate ring and bearing set.

The inner races of both bearings and the spacer ring are then clamped between the aforementioned shoulder of the shaft and a disk that is tightened by means of a screw bolt in the end of the shaft.

Now the pressure on the male rotor is removed and the outer races are clamped by a cover with a seal that is fastened to the housing with bolts, and which clamps the outer races of both bearings between the shoulder of the housing and the cover concerned.

After assembly the shaft can still move over an axial distance. This axial distance, or axial play, in the bearing set after assembly is the result of:

- the axial play in the bearing set, present before assembly;
- the reduction of this unassembled play by the diameter of the shaft under the inner races and the effect of the finishing tolerances;

- the reduction of this unassembled play by the diameter of the housing at the level of the outer races and the effect of the finishing tolerances.

The resulting maximum and minimum axial play between the rotating rotor body and the end walls of the housing is determined by:

- the choice of the thickness of the spacer ring;
- the axial play after assembly in the bearing set.

The minimum axial play must always be greater than the axial play after assembly in the bearing set, in order to prevent the rotor body from making contact with the end wall of the housing when rotating, which would lead to undesired friction and possibly to damage of the compressor element.

A disadvantage of this traditional method is that the variation of the play is quite large, as for the adjustment of the resulting play, this play depends on two important factors, i.e.:

- when selecting the "most suitable" thickness for the spacer ring it often has to be rounded off, where this rounding off depends on the operator who fits the compressor element, and,
- the axial play after assembly in the bearing set depends on the diameter and finishing tolerances of the cooperating components, such as the bearing races, the shaft and the housing.

SUMMARY OF THE DISCLOSURE

The present invention aims to provide a solution to one or more of the aforementioned and/or other disadvantages, by providing a method that enables the axial play to be adjusted reproducibly.

To this end the present invention provides a method for the axial positioning of bearings on a shaft journal of a rotor, whereby the axial play of the rotor in its housing is set by a spacer ring, characterised in that it comprises the following steps:

- setting the play of the rotor in the axial direction in the housing to zero by keeping the rotor body pressed in the direction of the shaft end concerned with a force;
- together with an interference fit, affixing a spacer ring and a first bearing to the aforementioned shaft journal, such that the outer race of the first bearing is pressed into a seat in the housing, and whereby this outer race is moved axially with respect to the inner race of the same bearing, over a distance that depends on the desired axial play;
- pressing a second bearing over the shaft journal and in the aforementioned seat, so that the inner race of this second bearing comes up against the inner race of the first bearing, without moving the first bearing and the spacer ring and whereby a gap is left between the outer races of the two bearings;
- axially locking the inner races of the bearings onto the shaft journal;
- removing the aforementioned force and axially locking the outer races of the bearings into the housing.

An advantage of the method according to the invention is that the play of the shaft can be accurately set and no longer depends on the chosen thickness of a loose spacer ring, as used in the traditional method.

In order to clamp the inner races of the bearings, use is preferably made of a nut that is screwed up against the inner race of the second bearing on an external screw thread provided on the shaft journal.

In order to clamp the outer races against the stop of the housing, use is preferably made of a cover that is screwed tight in the seat of the housing against the outer race of the second bearing.

Preferably the axial play is determined by the step difference on the contact surface of the first forcing piece.

Preferably the side of the spacer ring turned towards the rotor body is free in the axial direction, which means that the concerned side of this spacer ring does not rest against a stop or collar, but axially it is not up against anything.

Preferably the side of the spacer ring turned towards the rotor body defines a groove, together with the rotor body or a shoulder on the shaft, along which groove a lubricant can be supplied to the bearings.

In a preferred embodiment the stepped forcing piece shows a depth difference between the contact point with the innermost and the contact point with the outermost race of the first ball bearing, which depth difference is a function of the desired set play of the shaft in the housing, and the unstepped forcing piece does not present any depth difference between the contact point with the innermost and the contact point with the outermost race of the second ball bearing.

The spacer ring must be clamped sufficiently securely to the shaft, so as not to move under the influence of the pressing force applied to mount the second ball bearing.

According to the invention, the play is set in the assembled state and for an optimum value that minimises the energy consumption of the element on the shaft, whereby the element on the shaft can be a screw body of a compressor element, but also any other application of a shaft where the axial play is determined by a set of bearings, which can be coupled angular contact bearings arranged in an X configuration.

It goes without saying that this method according to the invention for the axial positioning of bearings on a shaft journal can be used for a number of applications of a rotating shaft, whereby the application in a compressor element is only an example.

DESCRIPTION OF THE DRAWINGS

In order to better demonstrate the characteristics of the invention, a preferred method according to the invention is described below, as an example without any limiting nature, referring to the accompanying drawings in which.

DETAILED DESCRIPTION

Figure 1:
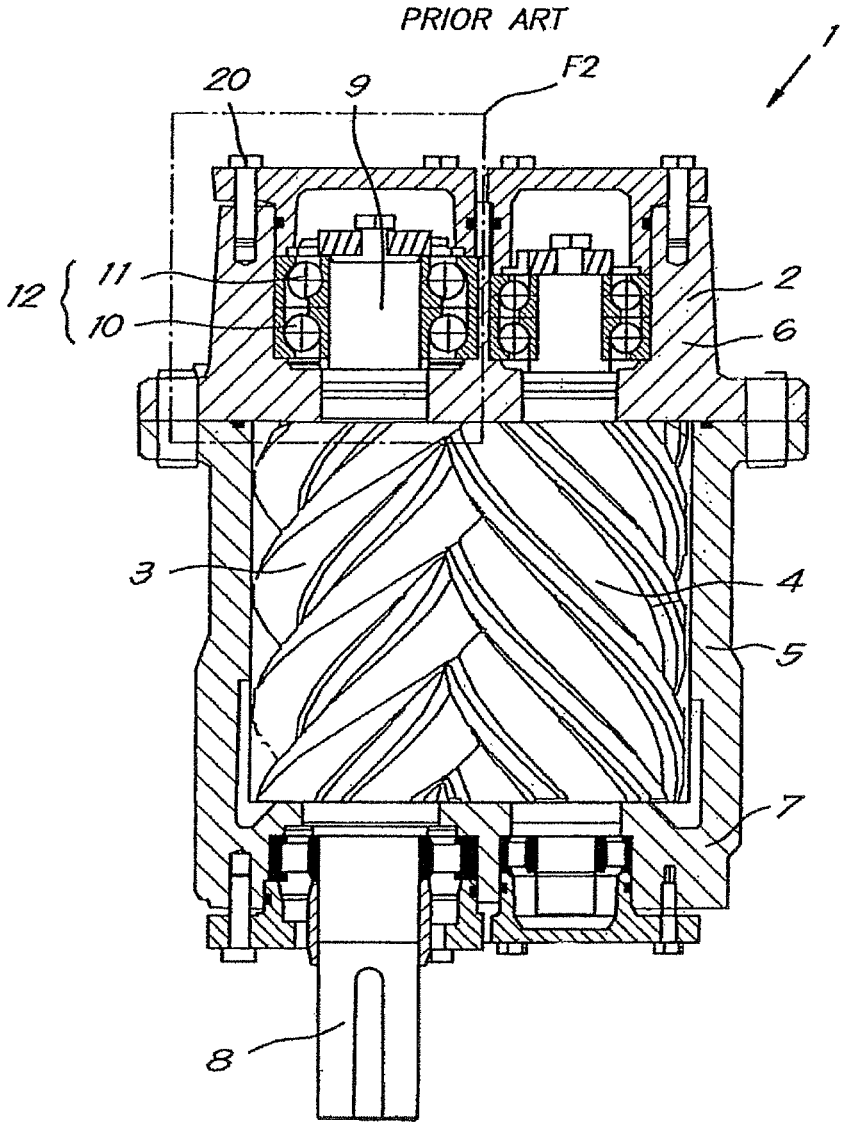
FIG. 1 schematically shows a cross-section of a screw compressor element according to the state-of-the-art.

FIG. 1 represents the cross-section of a screw compressor element 1 consisting of a housing 2 in which a male rotor 3 and a mating female rotor 4 are supported by bearings. The housing 2 consists of a casing 5 that surrounds the rotors 3 and 4, an end wall 6 on the high pressure side and an end wall 7 on the low pressure side, that together close off the casing 5.

At the ends of the male rotor 3 there is a shaft journal 8 on the inlet shaft and a shaft journal 9 on the outlet shaft that are supported by bearings in the end walls 7 and respectively. The outlet bearings 10 and 11 are both angular contact bearings and together form a coupled bearing set 12.

Figure 2:
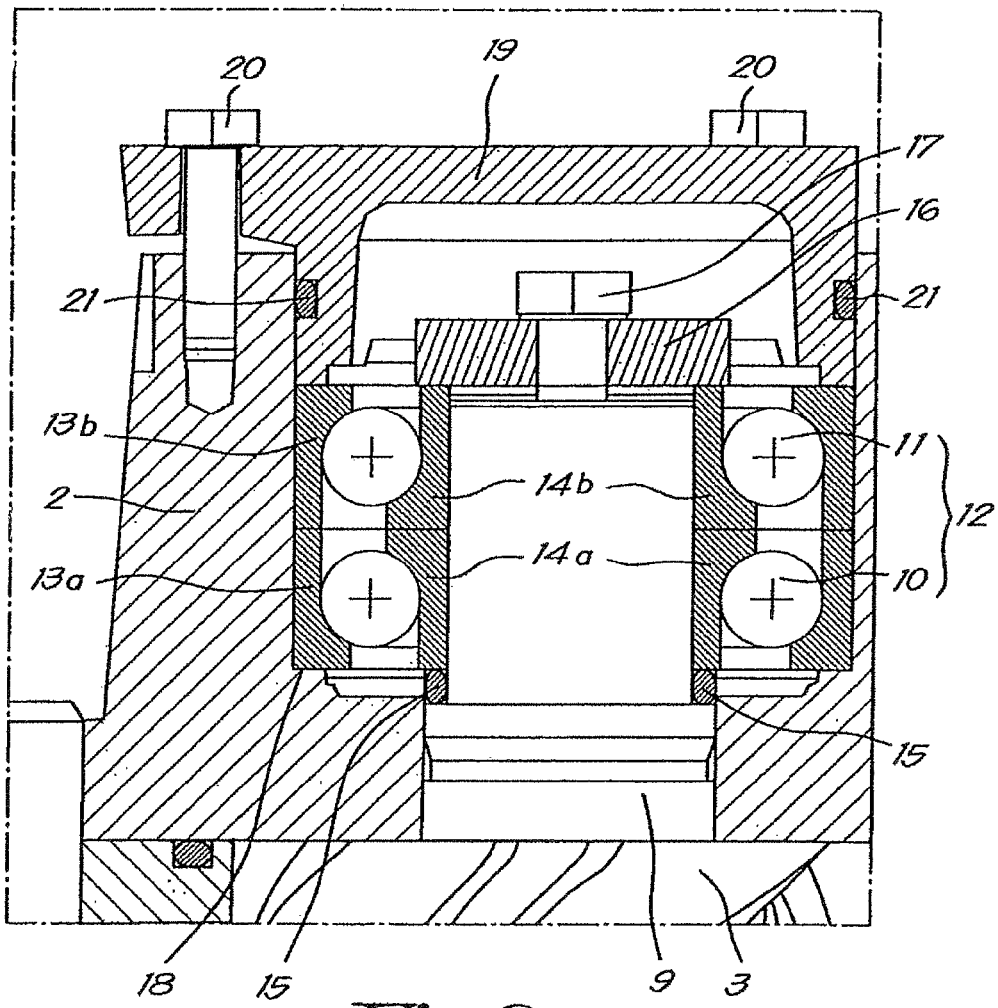
FIG. 2 shows the part designated as F2 in FIG. 1 in more detail.

FIG. 2 shows the bearings of the shaft journal 9 in the housing 2 more into detail. The bearing set 12 has stationary outer races 13*a*,13*b* that are mounted in the housing 2, and inner races 14*a*,14*b* that rotate with the shaft 9. The rotating inner races 14*a*,14*b* are bordered on the compressor side 14*a* by a spacer ring 15 and on the outside 14*b* by a disk 16, that is fastened to the shaft journal 9 by a screw bolt 17.

The stationary outer races 13*a,b* are bordered on the compressor side 13*a* by a shoulder 18 in the housing 2, and on the outside 13*b* by a cover 19 that is fastened to the housing 2 with screw bolts 20, and are also sealed 21.

Figure 3:
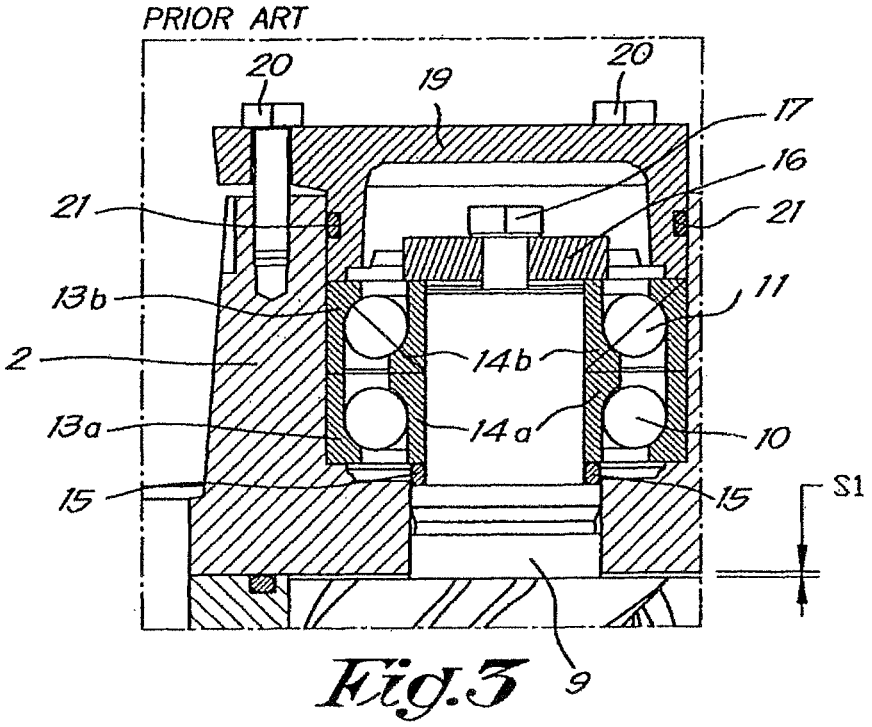
FIG. 3 shows FIG. 2 in the state of minimum axial play (S1) of the rotor in its housing.

FIG. 3 presents the bearing set 12 in FIG. 2 in a state with minimum play S1 for the shaft journal 9, whereby the rotor body is positioned close to the housing 2. This means that the rollers of the bearing 11 make contact with the inner and outer race.

Figure 4:
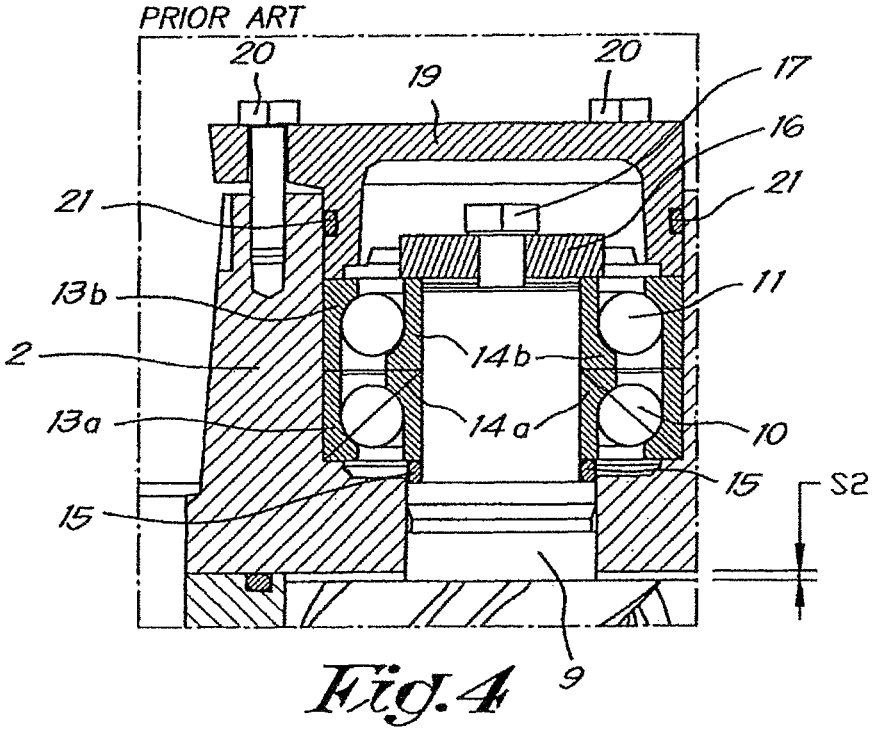
FIG. 4 shows FIG. 2 in the state of maximum axial play (S2) of the rotor in its housing.

FIG. 4 presents the bearing set 12 in FIG. 2 in a state of maximum play S2 of the shaft journal 9, whereby the rotor body is positioned further from the housing 2. This means that the rollers of bearing 10 make contact with the inner and outer race.

Figure 5:
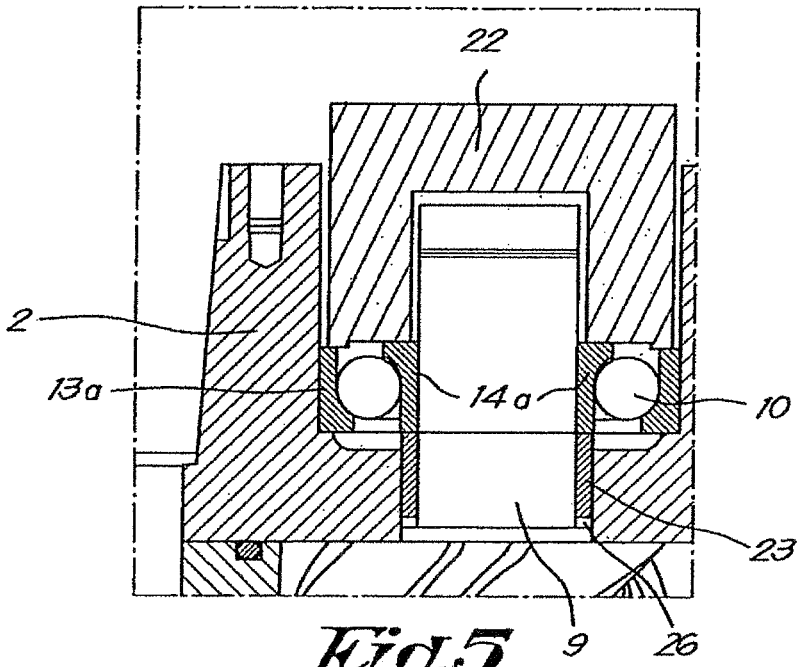
FIG. 5 shows a first assembly step of a method according to the invention.

FIG. 5 shows the first assembly step according to the invention of a bearing set 12 that is pressed around a shaft journal 9 with a forcing piece 22 with step difference and a spacer ring 23, on which rests a first outlet bearing 10 with its innermost rotating race 14*a*. All this while the play between the rotor and its housing 2 is set to zero by pressing the rotor body against the end wall 6.

Figure 6:
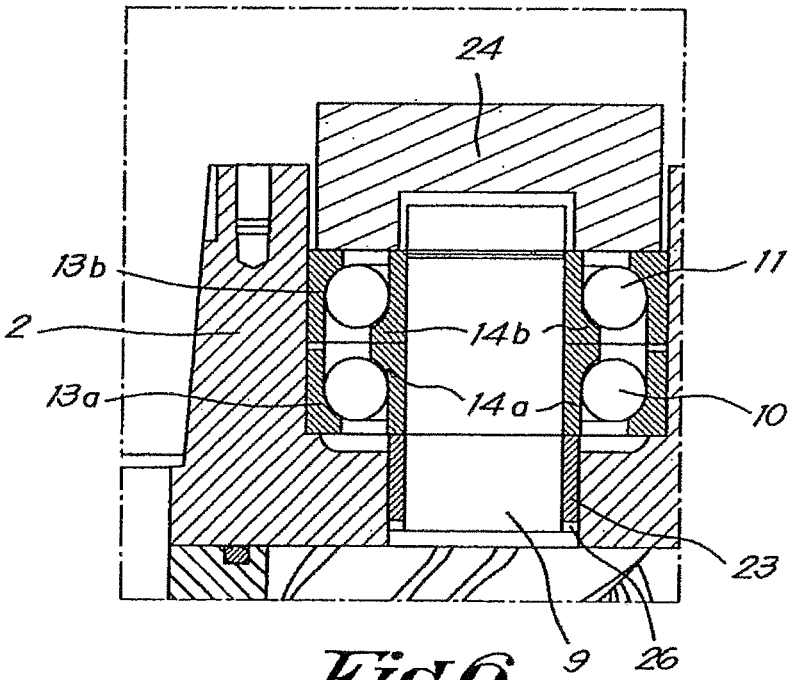
FIG. 6 shows a second assembly step of a method according to the invention.

FIG. 6 shows the second assembly step according to the invention of a bearing set 12, whereby a second outlet bearing 11 is pressed against the first outlet bearing 10 by a second forcing piece 24, without step difference, after which the second outlet bearing 11 rests on the first bearing 10 with its innermost race 14*b* on the innermost race 14*a* of the first bearing 10.

Figure 7:
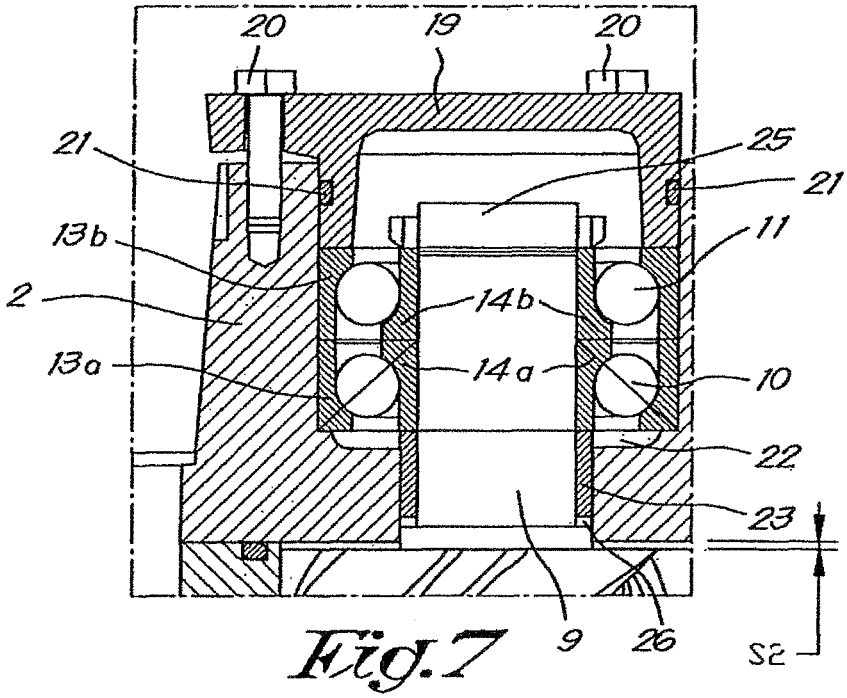
FIG. 7 shows a cross-section as in FIG. 2, but assembled using a method according to the invention and in a state of maximum axial play (S2) of the shaft in the housing.

FIG. 7 shows the third assembly step according to the invention of a bearing set whereby the second forcing piece 24 has been removed, and whereby a nut 25 is screwed on the shaft journal 9 using the external screw thread provided on the end of the shaft journal 9 for this purpose, and this in the state of maximum axial play S2, and whereby in the same state the cover 19 is also affixed with screw bolts 20.

Figure 8:
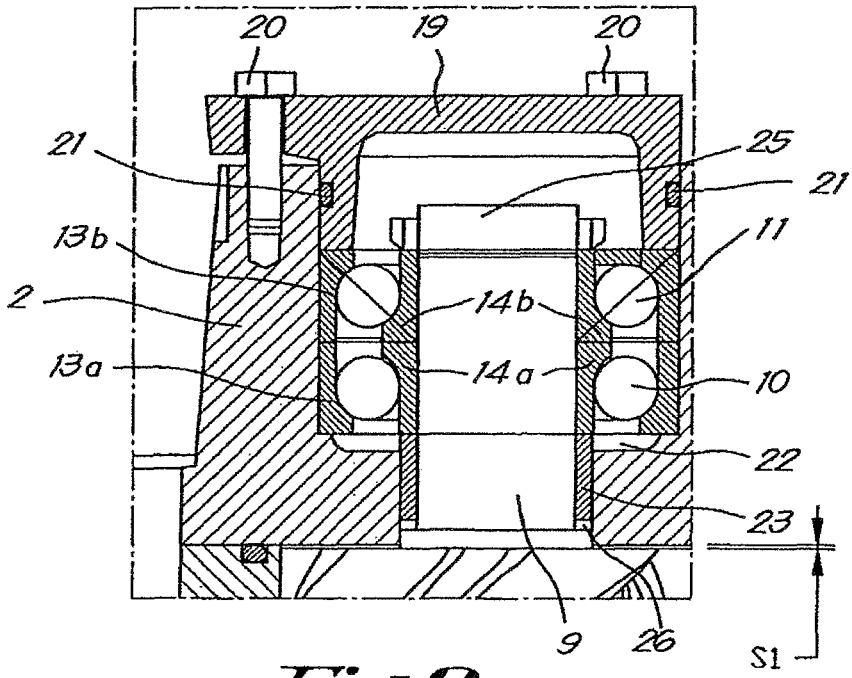
FIG. 8 shows a cross-section as in FIG. 7, but in a state of minimum axial play (S1) of the shaft in the housing.

FIG. 8 shows FIG. 7, but now in the state of minimum axial play S1.

The method for the axial positioning of bearings on a shaft journal according to the invention is very simple and as follows.

The method differs from the traditional method because the separate, loose spacer ring 15 is replaced by a pressed spacer ring 23 that is wider, and because preferably the disk 16 with screw bolt 17 is replaced by a nut 25 that is screwed onto the shaft journal 9 that now has an external screw thread, so that the force exerted on the bearing races and the spacer ring is limited, thereby preventing movement of these races. However, it remains possible to use the traditional disk 16 with screw bolt 17 provided that the force exerted remains limited.

A second difference with the traditional method is that a stepped forcing piece 22 is used for assembly, such that the axial play of the shaft can be adjusted accurately, as described below.

First of all the play of the shaft is set to zero by keeping the rotor body pressed against the housing 2. In a first assembly step a spacer ring 23 is pressed around the shaft, together with a first ball bearing 11. The forcing piece 22 that is used here, is stepped on the contact surface with the ball bearing 10 and is somewhat longer on its contact point with the outermost race 13*a* of the first ball bearing 10, such that a certain play arises between the inner race 14*a* and the ball of the ball bearing 10, which means that the shaft journal 9 can move axially over this distance.

In a second assembly step, the second ball bearing 11 is carefully pushed against the first ball bearing 10 with a second forcing piece 24, which this time is not stepped but completely flat so that the inner races 14*a*,14*b* of the second ball bearing 11 and the first ball bearing 10 are pressed against each other, but a gap remains between the outer races 13*a*,13*b* of the second ball bearings 10 and 11.

The spacer ring 23 is chosen such that it does not move under the influence of the force needed to fit the ball bearing 11.

In a third assembly step the inner races 14*a*,14*b* of both ball bearings 10,11 are axially secured with a nut 25. The use of such a nut 25 requires far less torque than the disk 16 and screw bolt 17 of the traditional method, such that movement of the spacer ring 23 is prevented.

It remains also possible to secure the inner races with the traditional disk 16 with screw bolt 17, if the torque is limited.

In a fourth assembly step, the force on the male rotor 3 is removed. Then the cover 19 is also fitted with screw bolts 20 to lock the stationary outer races 13*a,b* of the two ball bearings 10,11. The play, first present between the races and balls of ball bearing 10, now results in the play S2 of the rotor 3 in its housing.

The advantage of this method is that the play S2 is set by the step difference in the first forcing piece 22. This forcing piece 22 is independent of the width of the spacer ring 23 or the bearings 10,11. The operator thus no longer has to select a spacer ring 15 and no longer has to round off. The variation in the width of the spacer ring 23 due to the finishing tolerances is taken up by a groove 26 provided for this purpose over the entire circumference of the shaft journal 9, whose tolerance is sufficiently large. The play S2 is also adjusted in the assembled state.

In the traditional method the thickness of the spacer ring 15 is selected when the bearings have not yet been fitted, such that the diameters of the shaft journal 9 and the housing at the level of the bearing races 13,14 still had an influence on the resulting play S2. This is no longer the case with the new method according to the invention.

A benefit of the new method is that the play S2 can be adjusted more accurately, such that the variation in the play is less. This results in a smaller variation in the performance of the compressor element 1, that is directly related to the play S2. With the new method it is possible to set the play S2 to an optimum value, whereby the energy consumption of the compressor element 1 is minimal.

The present invention is not in any way limited to the method described as an example and shown in the drawings, but a method according to the invention can be realised in many different ways without acting outside the scope of the invention.

The invention claimed is:

1. A method for the axial positioning of bearings on a shaft journal of a rotor, wherein axial play of the rotor in a rotor housing is adjusted by a spacer ring, comprising the steps:

setting the play of the rotor in an axial direction in the housing to zero by keeping the rotor pressed in a direction of a respective shaft journal end with a force;

with an interference fit, affixing a spacer ring and a first bearing to the shaft journal, such that an outer race of the first bearing is pressed into a seat in the housing, so that the outer race is moved axially with respect to an inner race of the first bearing, over a distance that is selected to achieve a desired axial play;

pressing a second bearing over the shaft journal and in the seat, so that an inner race of the second bearing abuts the inner race of the first bearing, without moving the first bearing and the spacer ring, and so that a gap is left between the outer races of the two bearings;

axially locking the inner races of the bearings onto the shaft journal;

removing the force and axially locking the outer races of the bearings in the housing.

2. The method according to claim 1, including using a nut to clamp the inner races of the bearings, said nut being screwed up against the inner race of the second bearing on an external screw thread provided on the shaft journal.

3. The method according to claim 1, including using a cover to secure the outer races against the stop of the housing that is screwed tight in the seat of the housing up against the outer race of the second angular contact bearing.

4. The method according to claim 1, including determining the axial play by using a step difference on a contact surface of a first forcing piece.

5. The method according to claim 1, wherein a side of the spacer ring facing towards the rotor body is free in the axial direction.

6. The method according to claim 5, wherein the side of the spacer ring facing towards the rotor body defines a groove with the rotor or a shoulder of the shaft, to enable supply of a lubricant along the groove to the bearings.

7. The method according to claim 1, comprising the step of using an unstepped forcing piece having no depth difference between a contact point with the innermost race and a contact point with the outermost race of the second ball bearing.

8. The method according to claim 1, wherein a force applied for fitting the second bearing is less than a force needed to move the spacer ring and the inner race of the first bearing on the shaft journal.

9. The method according to claim 1, wherein the desired axial play is set in the assembled state.

10. The method according to claim 1, wherein the desired axial play is set to an optimum value, to result in minimal energy consumption of a compressor element associated with the rotor.

11. The method according to claim 1, wherein the rotor is a rotor of a screw compressor element.

12. The method according to claim 1, wherein said coupled bearings are angular contact bearings.

13. The method according to claim 12, wherein said bearings are in an X configuration.

* * * * *